US005952791A

United States Patent [19]

Watanabe et al.

[11] Patent Number: 5,952,791

[45] Date of Patent: Sep. 14, 1999

[54] APPARATUS FOR DETECTING ABNORMAL STATES IN A DISCHARGE TUBE CIRCUIT AND INFORMATION PROCESSING SYSTEM

[75] Inventors: Yoshiteru Watanabe, Sagamihara; Masaya Yamaguchi, Tokyo; Masaru Suzuki, Yokohama, all of Japan

[73] Assignee: International Business Machines Corporation, Armonk, N.Y.

[21] Appl. No.: 08/734,373

[22] Filed: Oct. 17, 1996

[30] Foreign Application Priority Data

Oct. 17, 1995 [JP] Japan ..... 7-268834

[51] Int. Cl.[6] ..... H05B 37/03

[52] U.S. Cl. ..... 315/225; 315/308; 315/274; 315/119; 345/212

[58] Field of Search ..... 345/102, 212; 315/308, 291, 225, 119, 274, DIG. 5; 361/5, 6, 78, 79, 36, 87; 323/268

[56] References Cited

FOREIGN PATENT DOCUMENTS 4225682 8/1992 Japan .

*Primary Examiner*—Arnold Kinkead

*Attorney, Agent, or Firm*—Ronald L. Drumheller

[57] ABSTRACT

Abnormal states in a high-voltage cable connected to a backlight of a liquid crystal display are detected. This invention includes: a secondary winding of a transformer; a discharge tube connected to the secondary winding of the transformer; means connected to the discharge tube for detecting a tube current; means connected to the secondary winding of the transformer for detecting a transformer current; and abnormal-state detection means for comparing a value of the tube current detected by the tube current detection means with a value of the transformer current detected by the transformer current detection means and interrupting a power supply if a difference greater than a predetermined value is detected. Thus, a case of lighting delayed due to the darkness effect can also be dealt with.

3 Claims, 7 Drawing Sheets

APPARATUS FOR DETECTING ABNORMAL STATES IN A DISCHARGE TUBE CIRCUIT AND INFORMATION PROCESSING SYSTEM

BACKGROUND OF THE INVENTION

1. Field of the Invention

The present invention relates to a liquid crystal display and more specifically, to an apparatus for detecting abnormal states in a high-voltage cable connected to a discharge tube of a liquid crystal display.

2. Related Art

Liquid crystal displays are used in portable computers, that is, notebook type or subnotebook type computers, principally because they are smaller in size and consume smaller quantities of current than a CRT. However, since there is a need to further downsize the computer itself for improved portability and as there are demands to use as large a screen as possible even with a portable computer, even the parts used in a liquid crystal display must also be downsized further. Thus, various schemes have been tried with the backlight used in a liquid crystal display. For example, the inverter was formerly loaded on the liquid crystal display side of the computer to minimize the length of high-voltage cable, but recently there are some constructions in which the inverter is loaded on the computer body side and the high-voltage cable passes through a hinge between the liquid crystal display and the computer body.

FIG. 9 shows one such example. A computer 1 includes a computer body 3 and a liquid crystal display 9. The computer body 3 includes a keyboard 7, a floppy disk drive 5, and a CPU, memory, hard disk drive and the like not shown here. This computer body 3 is connected to the liquid crystal display 9 by using hinges 11*a* and 11*b*. The liquid crystal display 9 delineates images on a liquid crystal display panel 13 and conveys the results processed in the computer body to a user. Simply put, what is normally termed a backlight comprises a discharge tube 15 and a light conducting panel and a diffusing panel on the back of the liquid crystal display panel 13. That is, one or more discharge tubes 15 are provided vertically as shown in FIG. 9, vertically at two sides of the display panel 13, or horizontally at one side or two sides of the display panel 13, and rays of light from the discharge tubes are conveyed via the light conducting plate and the diffusing plate to the whole liquid crystal display panel 13, so that the liquid crystal display panel 13 can be seen brightly. Incidentally, the value of voltage applied to the discharge tubes 15 may, for example, be on the order of 1200V at the start and 500V upon lighting.

As mentioned above, because conventional liquid crystal display panels 13 were formerly small compared to the size of the liquid crystal displays 9, etc., an inverter was also provided in the liquid crystal display 9. However, as shown in FIG. 9, an inverter 19 is now being provided in the computer body 3 by extending a high-voltage cable 17 to pass through the hinge 11*b*. With such a structure, the portion indicated by the circle A may be hazardous. That is, as the cable is subjected to repeated stress due to the movable hinge portion 11*b*, the core wire may consequently break.

There may also be cases where a structure must be used in which a high-voltage cable has to be passed not only through the area of circle A but also through an area where there is a great possibility of the cable being pinched by a screw or the frame.

In such cases, there may be situations where there are discharges at the break in the wire or the wire insulation may be torn so that there are discharges toward a screw or the frame. Although it is easy to make the cable difficult to break and the insulation hard to tear, these are not fundamental solutions to the problem.

Here, the construction of a conventional inverter will be described in reference to FIG. 10. A discharge tube 15 is connected through a ballast capacitor 23 to the secondary winding side of the transformer 21. To detect current flowing through this discharge tube 15, a tube current detection section 25 is mounted. The value of current detected in this tube current detection section 25 is fed back to keep the tube current constant. Here, a description of how the fed back value of current is used to keep the tube current constant will be omitted because it is not directly related to the gist of the present invention.

If a situation should occur where current is consumed by portions other than the discharge tube due to discharge or the like and the current flowing through the discharge tube 15 consequently decreases, the decrease in tube current causes the feed back to decrease so that it is possible to detect the above situation. However, the following problems have not yet been solved: 1) usually, if the tube current decreases, a positive feedback acts in such a manner to increase the tube current and consequently output increases. Thus, current increases and continues to flow until such a safety circuit as a fuse operates; 2) There is a darkening effect (when a cold cathode tube is lit after leaving it for some time in the dark, the lighting is delayed sometimes for several seconds or tens of seconds because the number of initial electrons is small) and, since output cannot be stopped even if no tube current flows directly after the start, the output must be continued for a while and no countermeasures whatever can be taken while the output continues. For example, when the above situation occurs in portion B of FIG. 10, no drastic countermeasures can be taken with the above conventional method.

Published Unexamined Patent Application (PUPA) No. 6-20779 for example, describes an arrangement for detecting abnormal states where either of two fluorescent tubes provided does not light, but nothing about how to deal with cases where only one fluorescent tube is provided nor how to handle the occurrence of a discharge or the like. PUPA No. 5-343187 describes an arrangement for detecting abnormal states at a place where an eddy current flows when a short circuit/open circuit occurs on the primary side of a transformer, but no countermeasures whatever against such abnormal states at the secondary side as discharge due to a high voltage. PUPA No. 4-342991 describes an arrangement provided to deal with an acoustic resonance phenomenon but nothing about countermeasures against discharge or like circumstances and further, since the reference voltage for detecting abnormal states is fixed, no countermeasures can be taken when the darkness effect is acting. Furthermore, PUPA No. 6-86454 discloses a structure for detecting the short circuit of a load but takes no account of such circumstances as discharge and no countermeasure can be taken when the darkness effect is present because abnormal states are detected by using an input voltage to the load as the reference voltage.

SUMMARY OF THE INVENTION

Considering the above matters, it is one object of the present invention to provide a mechanism that can cope with the following circumstances:

1) Where there is a discharge at a break in a cable core (also where the connector of a discharge tube is not securely plugged in).

This case includes both A) at the time of lighting and B) at the time of start (where the lighting was delayed due to the darkness effect).

2) Where the insulation of a cable is torn and discharge is made toward things in the vicinity.

This case includes both A) a state of partial contact and B) a state of complete contact.

To attain the above object, an apparatus for detecting abnormal states in a circuit for a discharge tube according to the present invention comprises: a transformer having primary and secondary windings; the discharge tube being connected to the secondary winding of the transformer; means connected to the discharge tube for detecting a tube current; means connected to the secondary winding of the transformer for detecting a transformer current; and abnormal-state detection means for comparing a value of the tube current detected by the tube current detection means with a value of the transformer current detected by the transformer current detection means and interrupting a power supply if a difference greater than a predetermined value is detected.

In this manner, the allocation of the detecting means on the secondary side enables a failure in the high-voltage cable to be dealt with and detecting the current flowing in the secondary winding of the transformer also enables a case of delayed lighting due to the darkness effect to be handled as well. The discharge tube mentioned here may be a cold cathode tube.

In this case, setting the detection sensitivity higher in the transformer current detection means than in the tube current detection means may also be considered. Since a change in current flowing through the secondary winding of the transformer becomes a great problem as shown before, countermeasures against unusual spikes or the like can be taken by raising the sensitivity.

In addition, it is also possible that both the tube current detection means and the transformer current detection means comprise: a resistor for converting a value of current into a value of voltage; a rectifier for performing rectification; and a capacitor and resistor for holding the rectified voltage.

Furthermore, it is also possible for the capacitor contained in the transformer current detection means to be smaller in capacitance than the capacitor contained in the tube current detection means and for the resistor contained in the transformer current detection means for holding said rectified voltage to be larger in resistance than the resistor contained in the tube current detection means for holding the rectified voltage. Such an arrangement enables spikes or the like in transformer current to be detected with good sensitivity.

It is also possible to provide an information processing system comprising a liquid crystal display including a discharge tube connected to the secondary winding of the transformer provided in the body of the information processing system and an information processing system body including a means connected to the discharge tube for detecting a tube current; means connected to the secondary winding of the transformer for detecting a transformer current; and abnormal-state detection means for comparing a value of the tube current detected by the tube current detection means with a value of the transformer current detected by the transformer current detection means to interrupt a power supply if a difference greater than a predetermined value is detected. Thus, an information processing system capable of coping with abnormal circumstances at early stage can be provided. The discharge tube mentioned here may be a cold cathode tube.

DESCRIPTION OF THE PREFERRED EMBODIMENT

Figure 1:
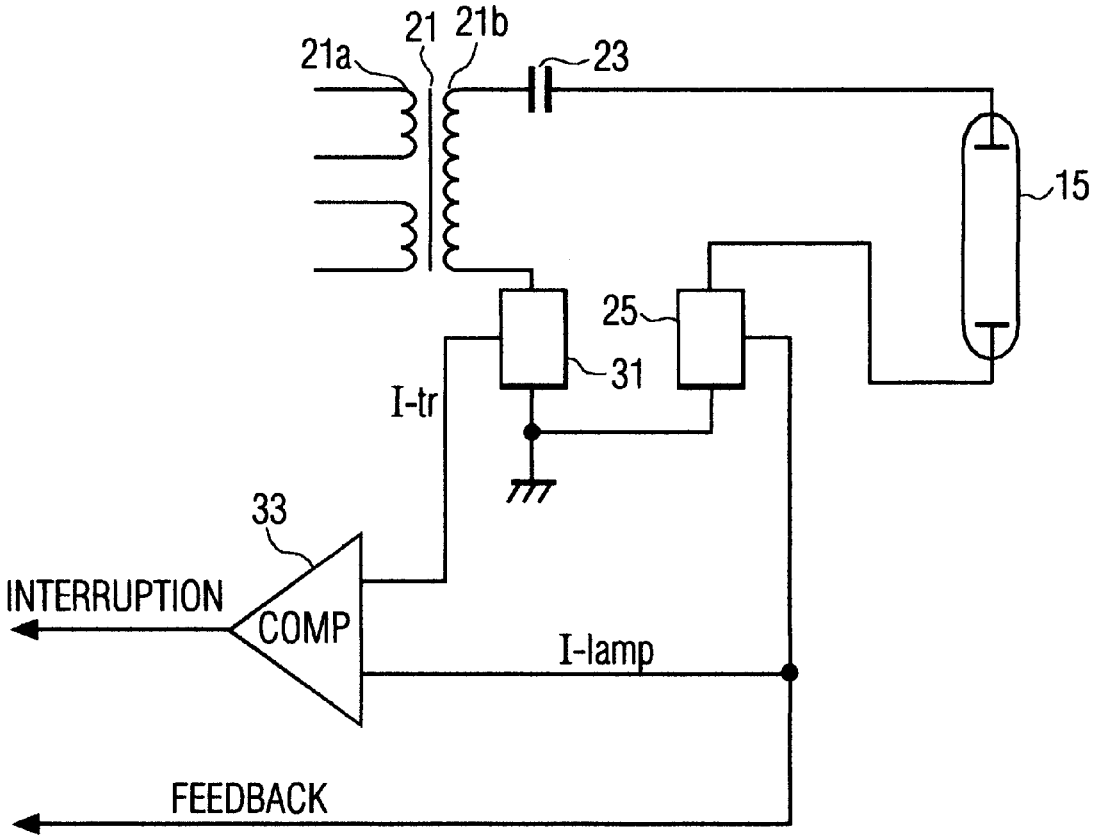
FIG. 1 is a block diagram showing a circuit example of the present invention.
Figure 10:
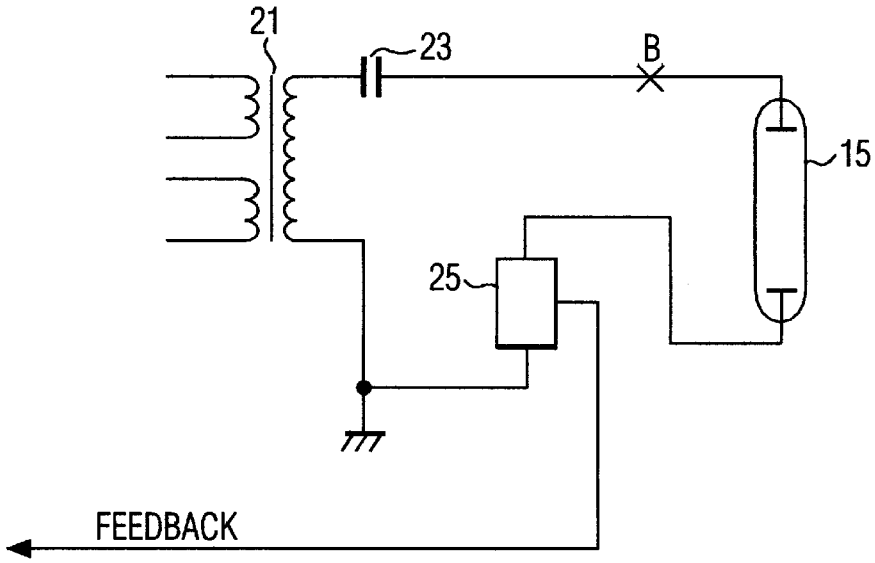
FIG. 10 PRIOR ART
FIG. 10 is a circuit diagram for illustrating the conventional art.

FIG. 1 shows one embodiment of the present invention. Like reference numerals are affixed to components similar to those shown before. If compared with FIG. 10, a transformer current detection section 31 is provided on the secondary winding 21*b* side of a transformer, the detected value of current I-tr and the value of current I-lamp detected by the tube current detection section 25 also present in FIG. 10 are input to a comparator 33 and an interrupt signal is arranged to be output in predetermined cases.

Normally, the transformer current on the secondary winding 21*b* side of the transformer is larger than tube current. This is because output of the transformer is high-voltage AC and a leakage current corresponding to stray capacity is generated, thereby preventing some current from reaching the discharge tube 15. This difference may be absorbed by the sensitivity of the current detection section or the like, or may be corrected by using a comparator 33.

After correcting for this leakage amount:

1) the operation is normal if I-tr≈I-lamp;
2) current is consumed in sites other than the discharge tube if I-tr>I-lamp; and
3) the state of I-tr<I-lamp does not occur in a simple failure mode. This state is considered attributable to a failure of a current detection section or the comparator, or the complex of a plurality of failures. In any case, since this is an abnormal state, countermeasures against this are needed. The comparator is arranged to detect states other than 1).

In addition, when discharge occurs, spike-shaped noises occur simultaneously in I-tr and a spike-shaped peak above the effective value can be observed. That is, if the transformer current detection section 31 is set to be as high in sensitivity as to react with such a spike-shaped peak, discharge from a high-voltage portion can be detected.

Figure 2:
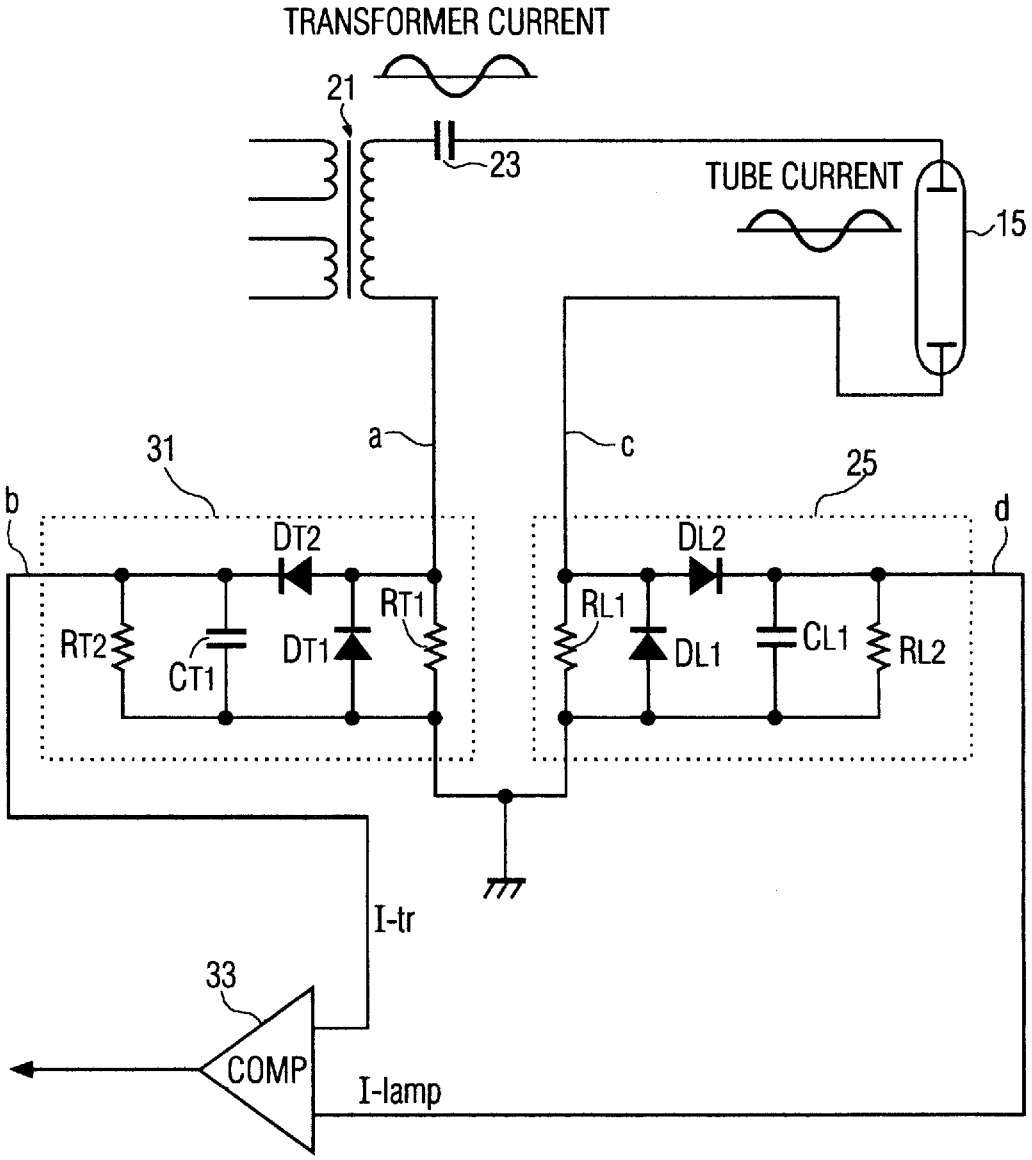
FIG. 2 is a circuit diagram showing one example of the current detection sections 25 and 31 in FIG. 1.

FIG. 2 is a detailed representation of each current detection section shown in FIG. 1. Except for the transformer current detection section 31 and the tube current detection section 25, parts shown are similar to those of FIG. 1. The transformer current detection section 31 and the tube current detection section 25 are common in the principle of converting a value of current into a value of voltage, rectifying it and detecting the rectified voltage. That is, the transformer current detection section 31 and the tube current detection section 25 convert a value of current into a value of voltage with $R_{L1}$, or $R_{T1}$, rectify it either with $D_{L1}$, and $D_{L2}$ or with $D_{T1}$ and $D_{T2}$, take out the rectified voltage either with $C_{L1}$ and $R_{L2}$ or with $C_{T1}$, and $R_{T2}$, and output it to a comparator 33. In this case, since the original difference mentioned above between the transformer current and tube current is not taken into consideration, this difference is dealt with by using the comparator 33.

As described above, because it is convenient to set the sensitivity of the transformer current detection section 31 to a higher value than that of the tube current detection section 25, it is recommended to make the capacity of $C_{T1}$ smaller. However, the resistance of $R_{F2}$ is made larger to maintain the voltage across this $C_{T1}$. For example, it is recommended to set $R_{L1}$ and $R_{L2}$ to 180Ω, $R_{L2}$ to 43 kΩ, $R_{T2}$ to 430 kΩ, $C_{L1}$ to 1 μF and $C_{T1}$ to 100 pF.

Here, the wave forms actually observed at the points a, b, c and d in FIG. 2 will be described for each of the various events.

Figure 3:
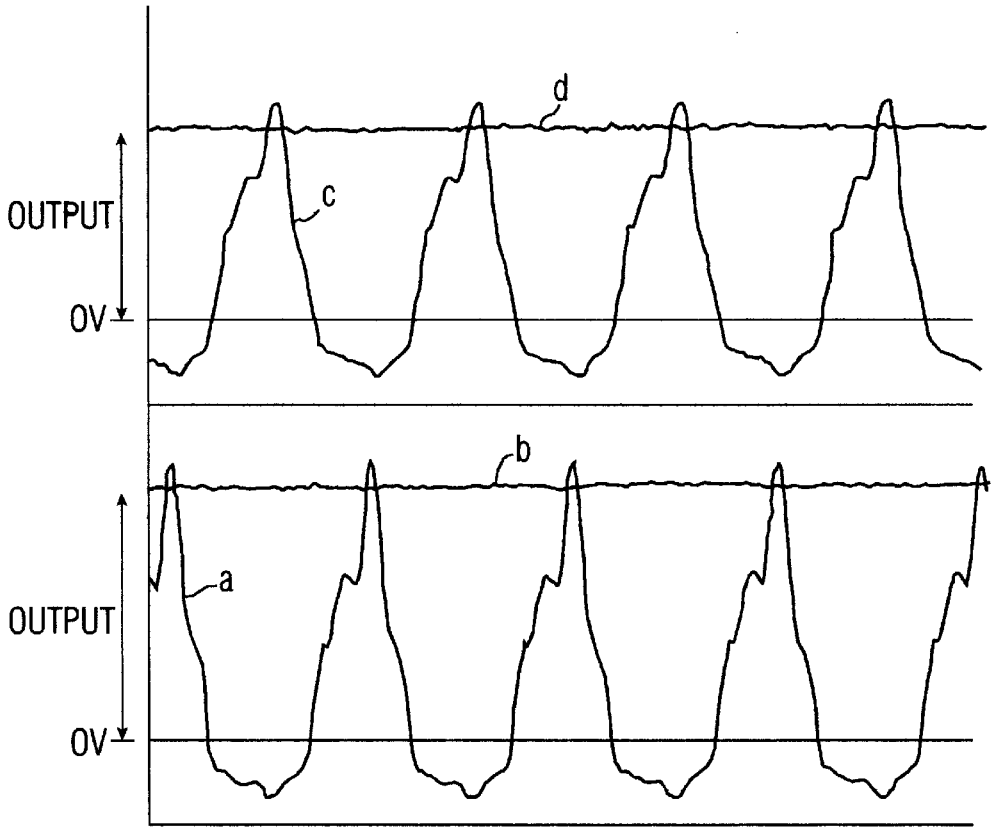
FIG. 3 is a graph showing the waveforms observed in positions a, b, c and d in FIG. 1 at the time of normal operation.

FIG. 3 shows the waveforms during normal operation. The upper and lower wave forms correspond to the points c and d of the tube current detection section 25 and to the points a and b of the transformer current detection section 31, respectively. This corresponding relation is the same in subsequent FIGS. 4–8. As mentioned above, the transformer current is larger than the tube current. However, since they are wave forms during normal operation, it must be arranged so that an interruption signal is not output for such a difference between the detection signals.

Figure 4:
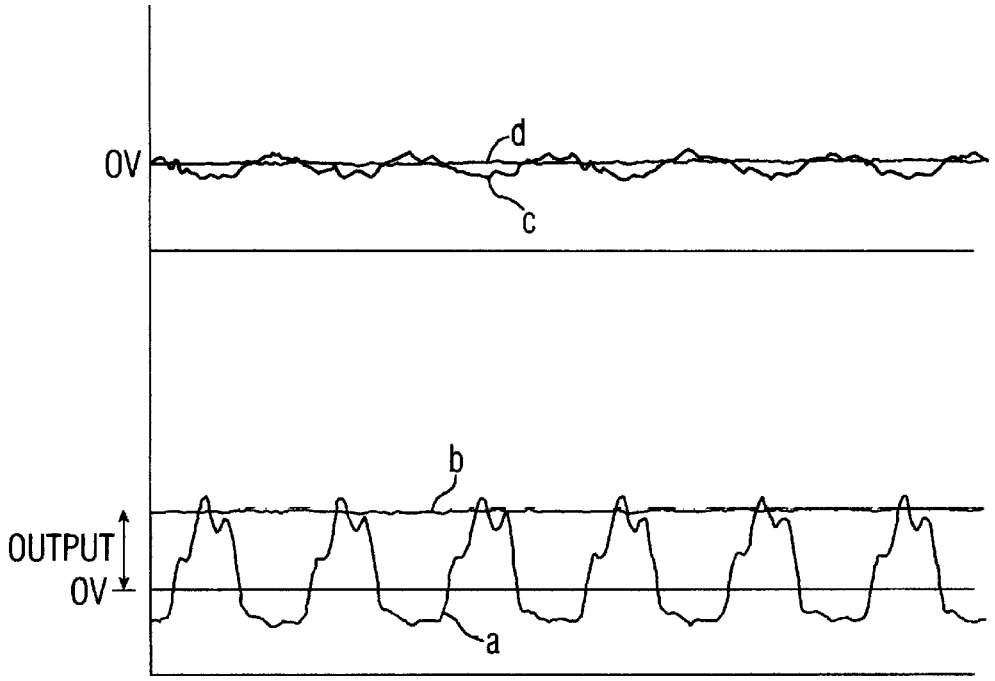
FIG. 4 is a graph showing the waveforms observed in positions a, b, c and d in FIG. 1 at the time of darkness effect.

FIG. 4 shows waveforms during a darkness effect period. In addition, the waveforms observed when no discharge tube is connected are the same as these. Naturally, at the points c and d of the tube current detection section 25 in the upper part, only a signal near 0V can be detected. In contrast to this, only a leakage current is observed at the points a and b of the transformer current detection section 31 in the lower part. Since this state cannot be said to be an abnormal state, it must be arranged so that an interruption signal is not output for this degree of current difference.

Figure 5:
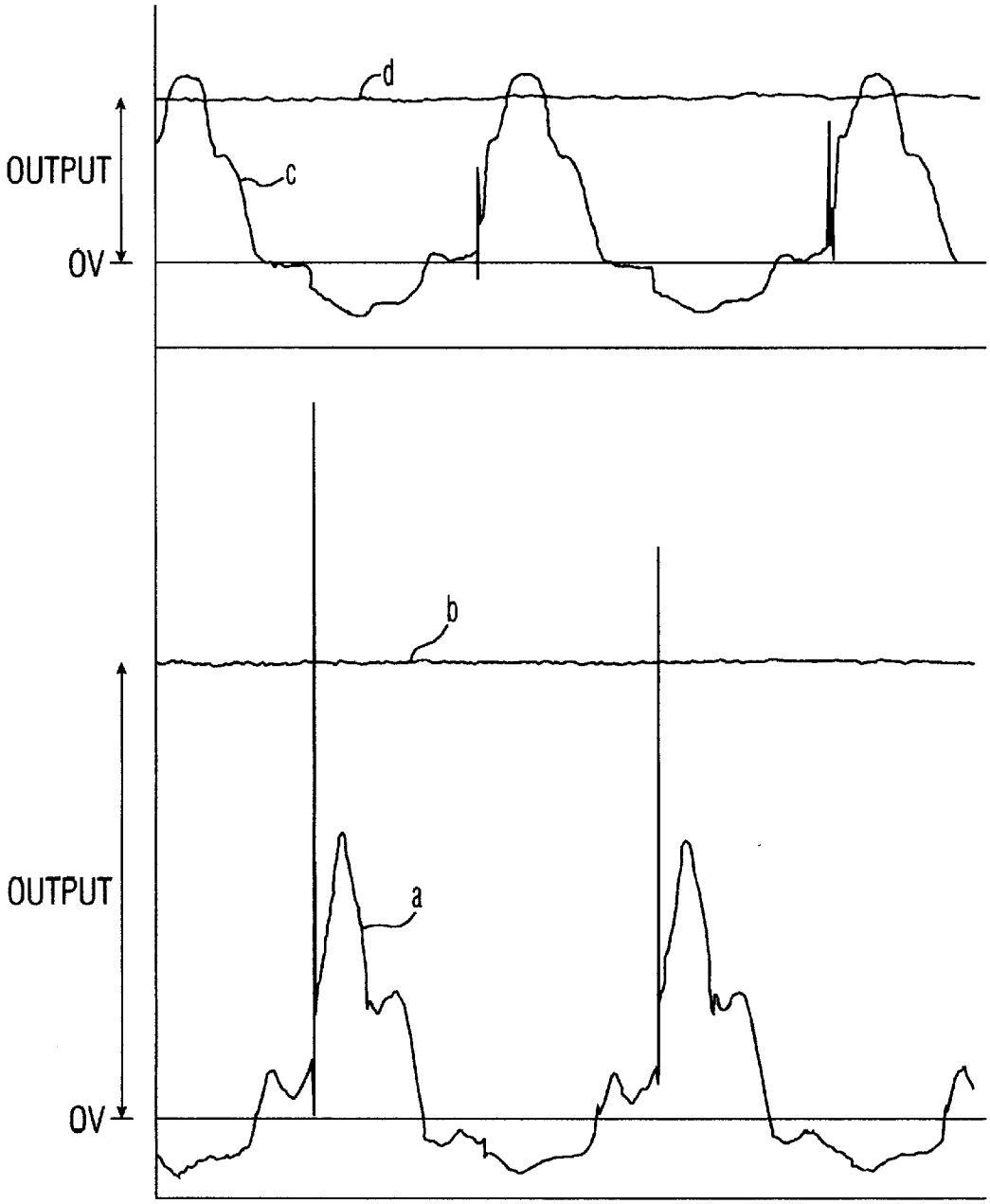
FIG. 5 is a graph showing the waveforms observed in positions a, b, c and d in FIG. 1 at the time of discharge.

FIG. 5 shows waveforms obtained when a cable is broken and discharge occurs between cable ends. From the signal a of the transformer current detection section 31 in the lower part, a peak caused by a spike is detected and such output as a signal b is obtained. Thus, if the signal b is compared with the signal d in the tube current detection section 25, the difference becomes larger than that observed in FIGS. 3 and 4. When such a large difference occurs, the comparator 33 is arranged to output an interruption signal.

Figure 6:
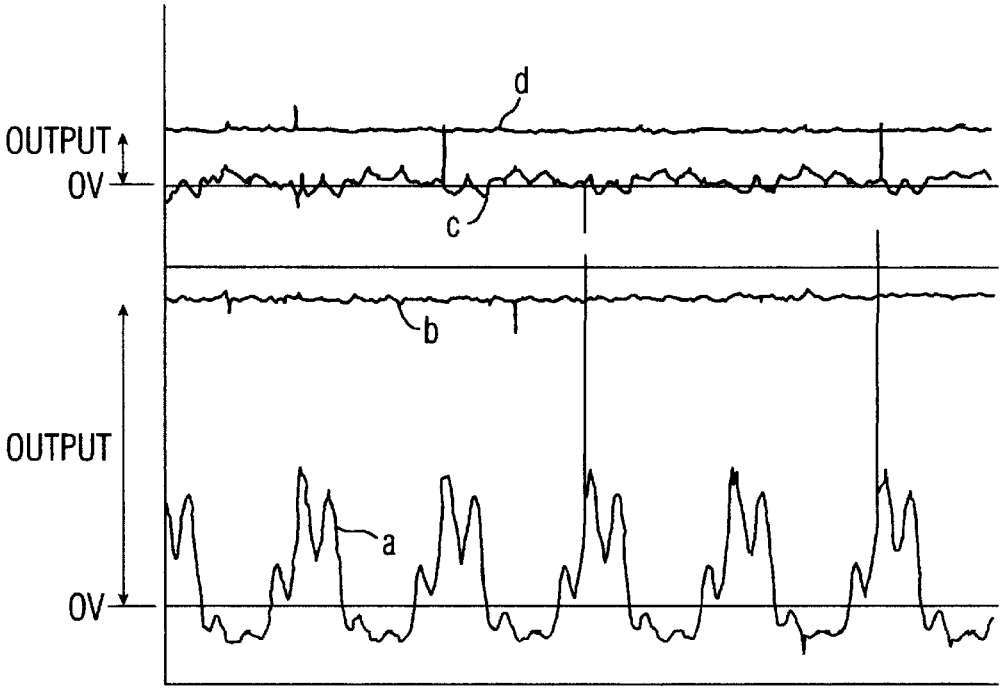
FIG. 6 is a graph showing the waveforms observed in positions a, b, c and d in FIG. 1 during the darkness effect and discharge occurs.

FIG. 6 shows waveforms obtained when a cable is broken during a darkness effect period and discharge occurs between cable ends.

At the time of darkness effect, the signals c and d of the tube current detection section 25 are nearly equal to 0 but the level of signals is somewhat raised in response to the noise of a spike and these signals are detected. The signal b of the transformer current detection section 31 detects the peak of the spike a and its level is raised. Thus, the difference in output between the detection sections becomes large and consequently the comparator 33 outputs an interruption signal.

Figure 7:
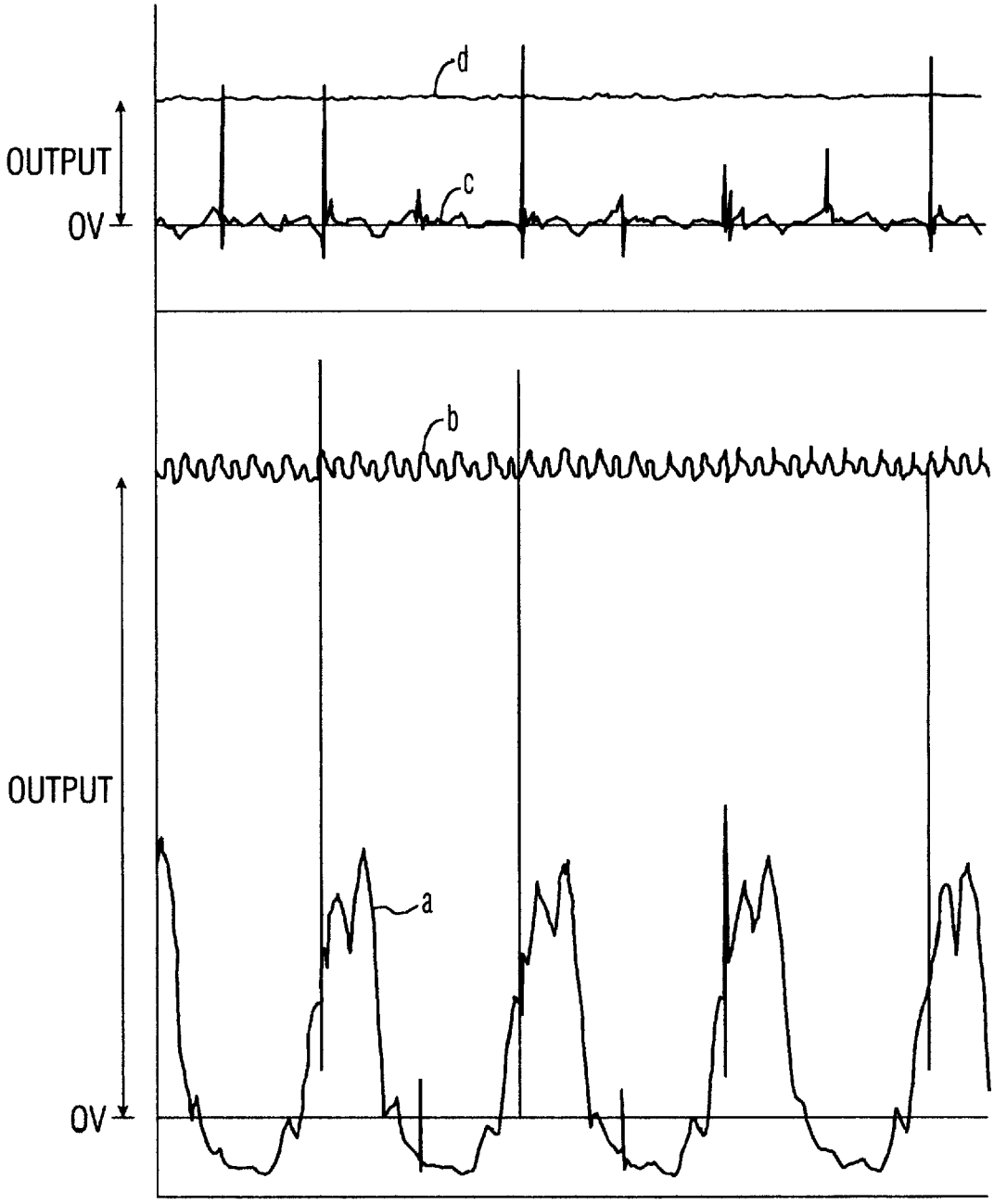
FIG. 7 is a graph showing the waveforms observed in positions a, b, c and d in FIG. 1 when the insulation of a cable is torn and discharge occurs.
Figure 9:
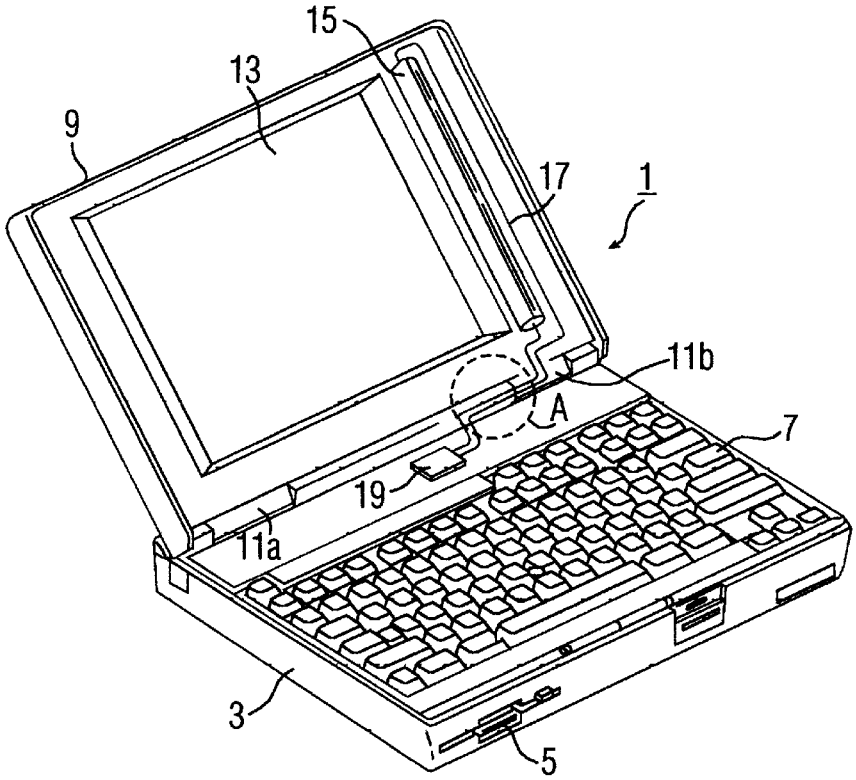
FIG. 9 PRIOR ART
FIG. 9 is a drawing for pointing out the problems to be solved by the present invention.

FIG. 7 shows waveforms obtained when the insulation of a cable is torn and discharge is made toward things in the vicinity. As with FIG. 6, spike peaks are detected and the level of a signal b in the transformer current detection section 31 is elevated. As compared with a signal d in the tube current detection section 25, a considerably large amount of current flows and consequently the comparator 33 outputs an interruption signal.

Figure 8:
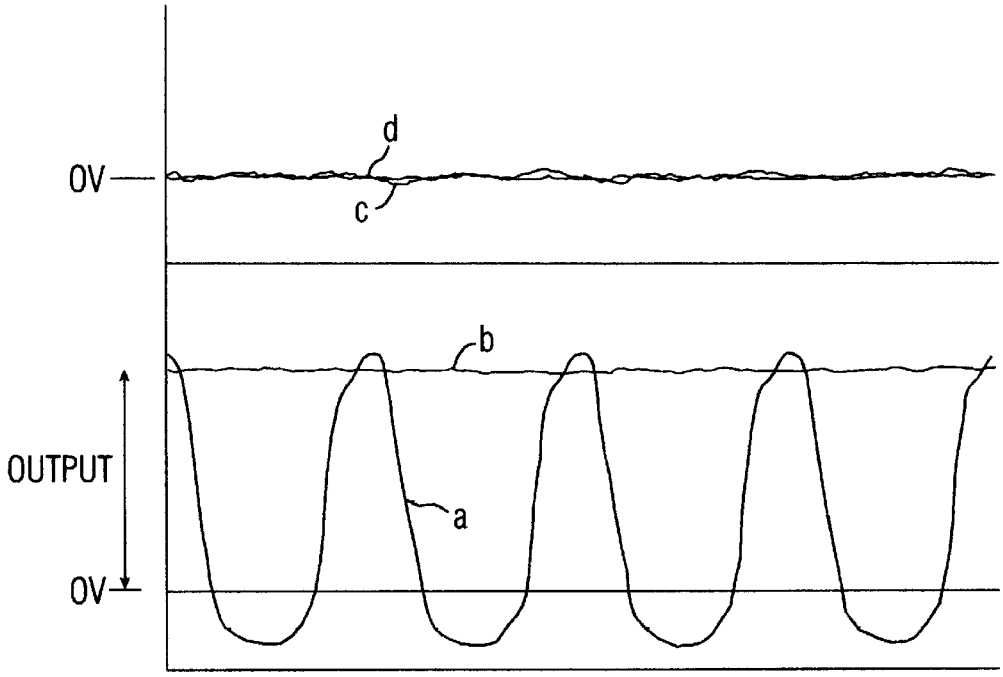
FIG. 8 is a graph showing the waveforms observed in positions a, b, c and d in FIG. 1 when the insulation of a cable is torn and the cable makes contact with things in the vicinity.

FIG. 8 shows waveforms obtained when the insulation of a cable is torn and the cable makes contact with things in the vicinity. In the case of contact, since no spike is detected, the level of a signal b in the transformer current detection section 31 is not elevated much but tube current (c, d) does not flow and exhibits nearly 0V, so that the output difference between the current detection sections becomes larger than normal. Thus, the comparator 33 outputs an interruption signal.

Heretofore, embodiments of the present invention have been shown, but the present invention is not limited to these embodiments. For example, comparison between tube current and transformer current is performed by a comparator 33 in the embodiments, but the comparison may be processed by using software such as microcode after converting both currents into numerical values with the aid of an A/D converter or the like.

The present invention may also be implemented by using other methods for detecting current.

Although the present invention was described in conjunction with a backlight of a liquid crystal display, it may also be applicable to implementation with other discharge tubes, e.g., fluorescent tubes.

Advantages of the Invention:

1) Situations where discharge is made at a break in a cable core (as well as where a connector is not securely plugged to a cold cathode tube) can be dealt with. In addition, both A) the time of lighting and B) the time of start (where the lighting was delayed due to the darkness effect) can also be handled.

2) Situations where the insulation of a cable is torn and discharge is made toward things in the vicinity can be dealt with. Further, both A) partial contact and B) complete contact can be dealt with.

We claim:

1. An apparatus for detecting abnormal states in a discharge tube circuit, comprising:

a transformer having primary and secondary windings, a discharge tube being connected to said secondary winding of the transformer;

means connected to said discharge tube for detecting a tube current;

means connected to said secondary winding of the transformer for detecting a transformer current; and abnormal-state detection means for comparing a value of the tube current detected by said tube current detection means with a value of the transformer current detected by said transformer current detection means and for interrupting a power supply if a difference greater than a predetermined value is detected, wherein said transformer current detection means has a detection sensitivity that is greater than a detection sensitivity of said tube current detection means.

2. An apparatus for detecting abnormal states in a discharge tube circuit, comprising:

a transformer having primary and secondary windings, a discharge tube being connected to said secondary winding of the transformer;

means connected to said discharge tube for detecting a tube current;

means connected to said secondary winding of the transformer for detecting a transformer current; and abnormal-state detection means for comparing a value of the tube current detected by said tube current detection means with a value of the transformer current detected by said transformer current detection means and for interrupting a power supply if a difference greater than a predetermined value is detected, wherein both said tube current detection means and said transformer current detection means comprise:

a resistor for converting a current value into a voltage value;

a rectifier for performing rectification and producing a rectified voltage; and a capacitor and resistor for holding the rectified voltage.

3. The apparatus as set forth in claim 2, wherein the capacitor contained in said transformer current detection means is smaller in capacitance than the capacitor contained in said tube current detection means, and the resistor contained in said transformer current detection means for holding said rectified voltage has greater resistance than the resistor contained in said tube current detection means for holding said rectified voltage.

* * * * *